US007134393B2

(12) United States Patent
Kusaka et al.

(10) Patent No.: US 7,134,393 B2
(45) Date of Patent: Nov. 14, 2006

(54) OSCILLATION AMOUNT ADJUSTING DEVICE FOR OSCILLATING ROLLER

(75) Inventors: Akehiro Kusaka, Noda (JP); Takashi Fuseki, Toride (JP)

(73) Assignee: Komori Corporation, Tokyo (JP)

( * ) Notice: Subject to any disclaimer, the term of this patent is extended or adjusted under 35 U.S.C. 154(b) by 121 days.

(21) Appl. No.: 10/889,031

(22) Filed: Jul. 13, 2004

(65) Prior Publication Data

US 2005/0039617 A1 Feb. 24, 2005

(30) Foreign Application Priority Data

Jul. 14, 2003 (JP) ..... 2003-196332

(51) Int. Cl.
*B41F 31/00* (2006.01)

(52) U.S. Cl. ..... 101/352.06; 101/DIG. 38; 101/350.3

(58) Field of Classification Search ..... 101/148, 101/277, 349.1, 350.1, 350.3, 352.06, DIG. 38
See application file for complete search history.

(56) References Cited

U.S. PATENT DOCUMENTS 4,332,195 A * 6/1982 Mizumura ..... 101/350.3
4,972,771 A * 11/1990 Weisgerber et al. ..... 101/148
5,060,568 A * 10/1991 Jentzsch et al. ..... 101/148
5,363,763 A * 11/1994 Fiore ..... 101/350.3
6,019,038 A * 2/2000 Kusunoki et al. ..... 101/216
6,220,159 B1 * 4/2001 Wieland ..... 101/349.1
6,546,865 B1 * 4/2003 Fischer et al. ..... 101/350.3
6,578,481 B1 * 6/2003 Beisel et al. ..... 101/350.3
6,691,612 B1 * 2/2004 Herrmann et al. ..... 101/352.01

FOREIGN PATENT DOCUMENTS

JP 54-3763 2/1979
JP 56-6864 B2 2/1981
JP 61237645 A * 10/1986
JP 2001-199051 A 7/2001

* cited by examiner

*Primary Examiner*—Ren Yan
(74) *Attorney, Agent, or Firm*—Birch, Stewart, Kolasch & Birch, LLP

(57) ABSTRACT

In an oscillating roller swing device including an oscillating roller, a rotating shaft having an inclined shaft portion, a cylindrical sleeve rotatably supported on the inclined shaft portion of the rotating shaft, a disk rotatably supported on the sleeve, and an oscillation drive motor for rotating the rotating shaft, an oscillation amount adjusting device for an oscillating roller comprises: a fitting groove provided in the sleeve; a parallel shaft portion having an axis parallel to the axis of the oscillating roller; a rotating member rotatably supported on the parallel shaft portion and provided with a fitting protrusion engaging the fitting groove of the sleeve; and an oscillation amount adjusting motor for rotating the rotating member relative to the rotating shaft.

8 Claims, 9 Drawing Sheets

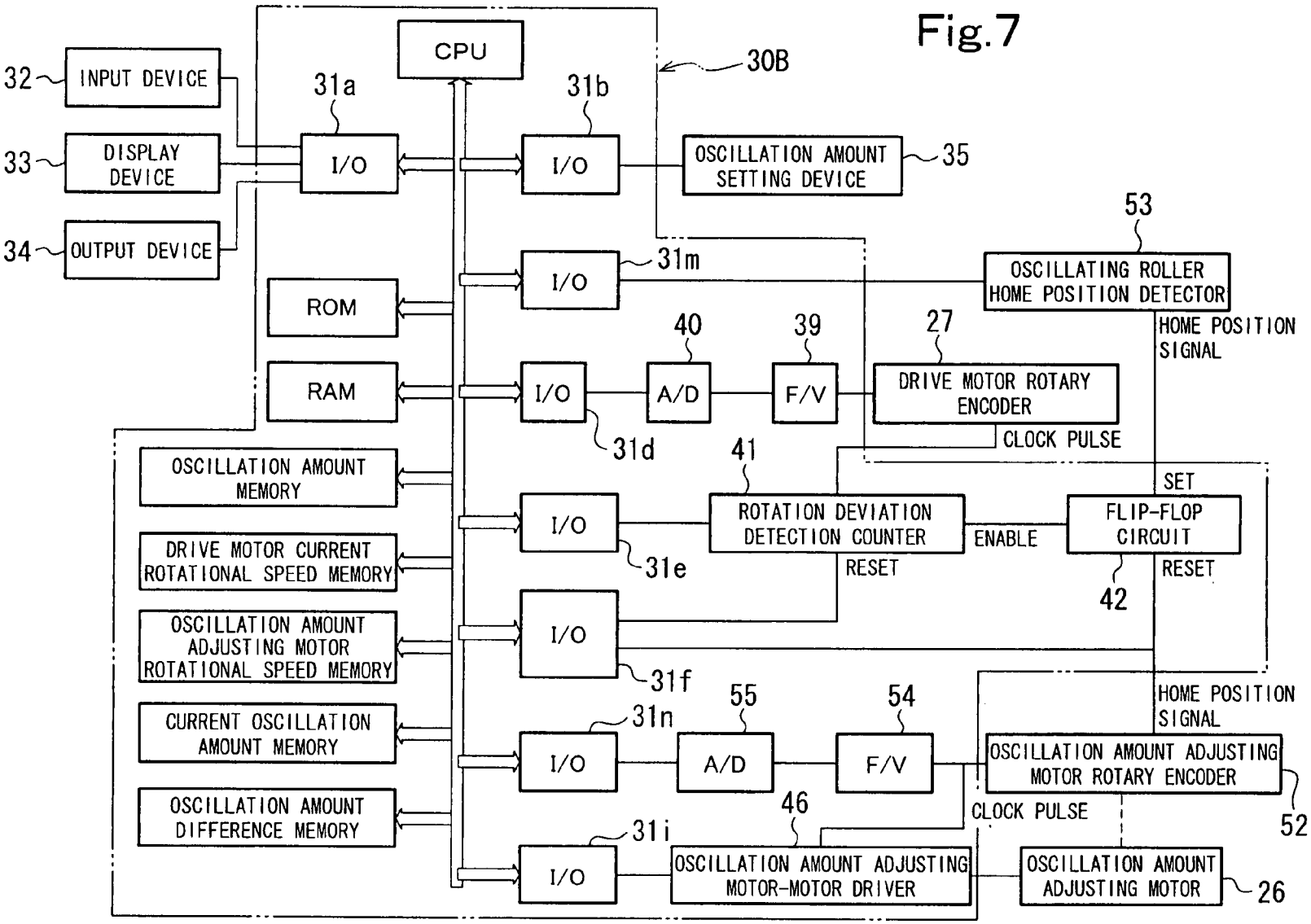
Fig.7
30B
CPU
31a
I/O
INPUT DEVICE
32
DISPLAY DEVICE
33
OUTPUT DEVICE
34
31b
I/O
OSCILLATION AMOUNT SETTING DEVICE
35
ROM
RAM
31m
I/O
OSCILLATING ROLLER HOME POSITION DETECTOR
53
HOME POSITION SIGNAL
31d
I/O
A/D
40
F/V
39
DRIVE MOTOR ROTARY ENCODER
27
CLOCK PULSE
OSCILLATION AMOUNT MEMORY
DRIVE MOTOR CURRENT ROTATIONAL SPEED MEMORY
31e
I/O
ROTATION DEVIATION DETECTION COUNTER
41
RESET
ENABLE
FLIP-FLOP CIRCUIT
42
SET
RESET
OSCILLATION AMOUNT ADJUSTING MOTOR ROTATIONAL SPEED MEMORY
31f
I/O
HOME POSITION SIGNAL
CURRENT OSCILLATION AMOUNT MEMORY
31n
I/O
A/D
55
F/V
54
OSCILLATION AMOUNT ADJUSTING MOTOR ROTARY ENCODER
52
CLOCK PULSE
OSCILLATION AMOUNT DIFFERENCE MEMORY
31i
I/O
OSCILLATION AMOUNT ADJUSTING MOTOR-MOTOR DRIVER
46
OSCILLATION AMOUNT ADJUSTING MOTOR
26

OSCILLATION AMOUNT ADJUSTING DEVICE FOR OSCILLATING ROLLER

CROSS REFERENCE TO RELATED APPLICATION

The entire disclosure of Japanese Patent Application No. 2003-196332 filed on Jul. 14, 2003, including specification, claims, drawings and summary, is incorporated herein by reference in its entirety.

BACKGROUND OF THE INVENTION

1. Field of the Invention

This invention relates to an oscillation amount adjusting device for an oscillating roller in an inking device of a printing press. More specifically, the invention relates to an oscillation amount adjusting device which can make adjustment by remote and automatic control using a motor while achieving space saving without exerting adverse influence on printing.

2. Description of the Related Art

In an inking device of a printing press, ink in an ink reservoir is sequentially fed to many distribution rollers via ink ductor rollers. In the distribution rollers, the ink is uniformly distributed, and transferred to a printing plate supported on the circumferential surface of a plate cylinder. The above-mentioned many distribution rollers consist of combinations of metal rollers and rubber rollers. Among them, the metal roller is called an oscillating roller, which is designed to swing laterally (in a roller axis direction) under the action of a swing device (oscillation mechanism) while rotating, thereby distributing the ink uniformly.

When rainbow printing is to be performed, or when the machine speed has been changed, it becomes important to adjust the oscillation amount of the oscillating roller. A conventional oscillation amount adjusting device for adjusting the amount of oscillation by remote and automatic control is disclosed, for example, in Japanese Patent Application Laid-Open No. 2001-199051 (hereinafter referred to as Patent Document 1). However, this oscillation amount adjusting device has a large-scale drive system composed of a rotating drum, a shaft, a lever, and a link plate, thus requiring a large space, posing the problem that its installation may be difficult in view of roller arrangement and its relation with other devices.

Furthermore, the oscillation amount adjusting device of Patent Document 1 swings a plurality of oscillating rollers in the roller axis direction by interconnecting these rollers by levers. Thus, the plurality of oscillating rollers simultaneously stop at the position of the swing end, presenting the problem that the thickness of an ink film tends to be uneven. Also, the plurality of oscillating rollers simultaneously stop and begin to move in the reverse direction, causing the problem that shock due to load increases to affect printing adversely.

To solve these problems, it is conceivable to adopt an oscillation mechanism designed to produce differences in the phase of each oscillating roller in its swing motion by the grinding motion of a disk, as disclosed in Japanese Utility Model Publication No. 1979-3763 (hereinafter referred to as Patent Document 2).

In adjusting the oscillation amount of the oscillating roller in the oscillation mechanism disclosed in the above-mentioned Patent Document 2, a method as disclosed in Japanese Patent Publication No. 1981-6864 (hereinafter referred to as Patent Document 3) is adopted. As shown in FIG. 9, a cylindrical sleeve 102 having an outer peripheral surface inclined with respect to the axis of an inclined shaft portion 101 of a rotating shaft 100 is rotatably fitted on the inclined shaft portion 101, and shaft ends of a plurality of oscillating rollers 104*a*, 104*b* . . . are rotatably supported on a disk 103 rotatably supported by the sleeve 102.

Thus, when the rotating shaft 100 is rotated in a manner interlocked with a drive motor or the like of a printing press, the inclined shaft portion 101 of the rotating shaft 100, which has an inclined axis, makes an oscillatory motion. The disk 103, which is journaled about the inclined shaft portion 101 via the sleeve 102, makes a so-called grinding motion. During this process, the oscillating rollers 104*a*, 104*b* . . . swing in the axial direction, with their phases being sequentially shifted in accordance with the order of arrangement of the oscillating rollers 104*a*, 104*b*. . . .

In adjusting the amount of oscillation of the oscillating rollers 104*a*, 104*b* . . . , driving of the printing press is once shut down. Then, an operator loosens an adjusting bolt 105 manually, inserts a tool into a hole 102*a* of the sleeve 102 to rotate the sleeve 102 by a predetermined angle, and then tightens the adjusting bolt 105 to lock the sleeve 102 to the rotating shaft 100 again.

In the oscillation amount adjusting device disclosed in the aforementioned Patent Document 3, the operator has to rotate the sleeve 102 manually while moving all of the oscillating rollers 104*a*, 104*b* . . . remaining stopped. Thus, a burden is imposed on the operator. Moreover, the accuracy of adjustment depends on the technical ability of the individual operator. Hence, if, after adjustment, the printing press is driven and the adjustment proves unsuccessful, the printing press must be shut down and adjusted again, thus posing the problem of taking time.

SUMMARY OF THE INVENTION

The present invention has been accomplished in light of the above-described problems with the earlier technologies. Its object is to provide an oscillation amount adjusting device for an oscillating roller, which can make adjustment by remote and automatic control using a motor or the like while achieving space saving without exerting adverse influence on printing.

To attain the above object, there is provided, according to the present invention, an oscillation amount adjusting device for an oscillating roller in an oscillating roller swing device, the oscillating roller swing device including an oscillating roller swung in an axial direction, a rotating shaft rotatably supported by a frame and having an inclined shaft portion inclined with respect to an axis of the oscillating roller, a cylindrical sleeve rotatably supported on the inclined shaft portion of the rotating shaft and having an outer peripheral surface inclined with respect to an axis of the inclined shaft portion, an oscillating roller engagement member rotatably supported on the sleeve and having an engagement portion engaging the oscillating roller, and first drive means for rotating the rotating shaft, the oscillation amount adjusting device, comprising:

an engaging portion provided in the sleeve;

a parallel shaft portion having an axis parallel to the axis of the oscillating roller;

a rotating member rotatably supported on the parallel shaft portion and provided with an engaged portion engaging the engaging portion of the sleeve; and second drive means for rotating the rotating member relative to the rotating shaft.

Thus, a high accuracy adjustment can be made by remote and automatic control using a motor, so that marked reduction of the working time is achieved. Since the oscillation phases of the respective oscillating rollers are rendered different, moreover, printing is not adversely affected, and simplification of the apparatus results in space saving.

The parallel shaft portion may be provided in the rotating shaft.

A differential mechanism may be provided on a drive route between the rotating member and the first drive means, and the differential mechanism may adjust a rotation phase between the rotating member and the first drive means by the second drive means.

The differential mechanism may be a harmonic drive device, the output side of the harmonic drive device may be connected to the rotating member via a gear mechanism and the input side of the harmonic drive device may be connected to the rotating shaft via a gear mechanism, and a wave generator of the harmonic drive device may be connected to the second drive means via a gear mechanism.

The first drive means and the second drive means may be motors.

Of the first drive means and the second drive means, one may be a dedicated motor, and the other may be a drive motor for driving the entire machine.

The first drive means may be the drive motor for driving the entire machine and may be connected to the rotating shaft via a gear mechanism, while the second drive means may be the dedicated motor and may be connected to the rotating member via a gear mechanism.

The oscillation amount adjusting device may further comprise: an oscillation amount setting device for setting the swing amount of the oscillating roller; a drive amount detector for detecting the drive amount of the second drive means; and a control device for controlling the second drive means in response to a signal from the oscillation amount setting device and a signal from the drive amount detector.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 7 is a control block diagram;

DETAILED DESCRIPTION OF THE INVENTION

An oscillation amount adjusting device for an oscillating roller according to the present invention will now be described in detail by embodiments with reference to the accompanying drawings, which in no way limit the invention.

First Embodiment

Figure 1:
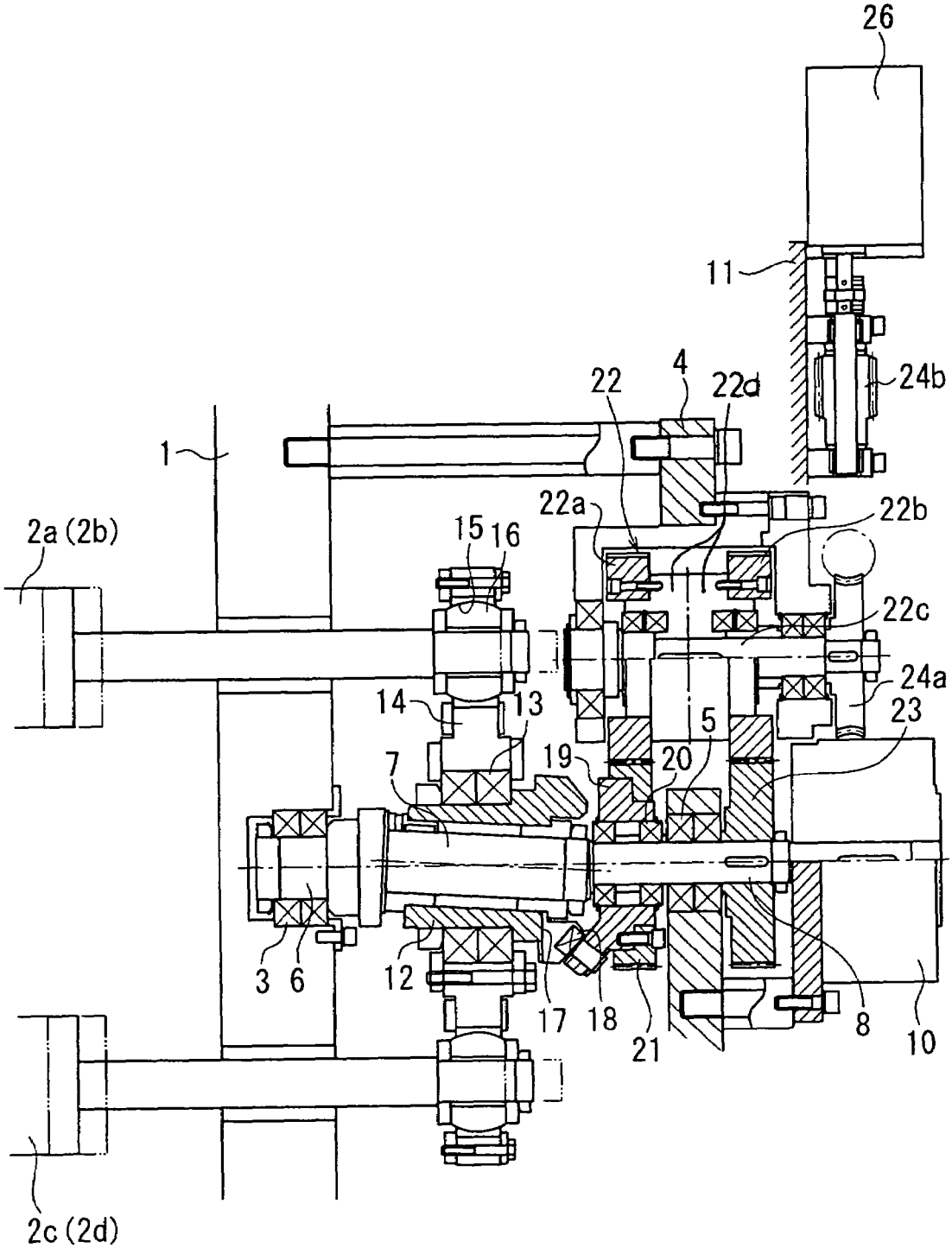
FIG. 1 is a front sectional view of an oscillating roller swing device of an inking device in a printing press, showing a first embodiment of the present invention.

FIG. 1 is a front sectional view of an oscillating roller swing device of an inking device in a printing press, showing a first embodiment of the present invention.

Figure 2:
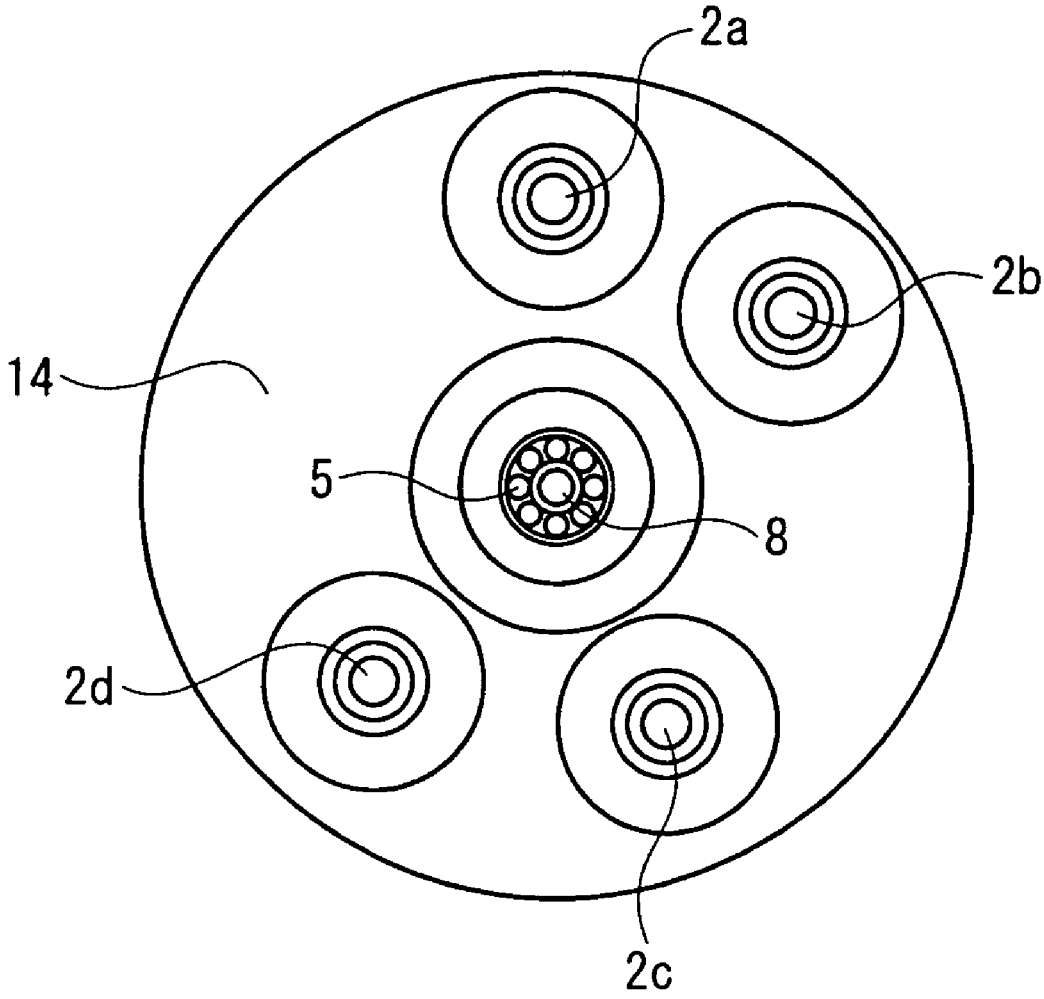
FIG. 2 is a side view of essential parts.
Figure 3:
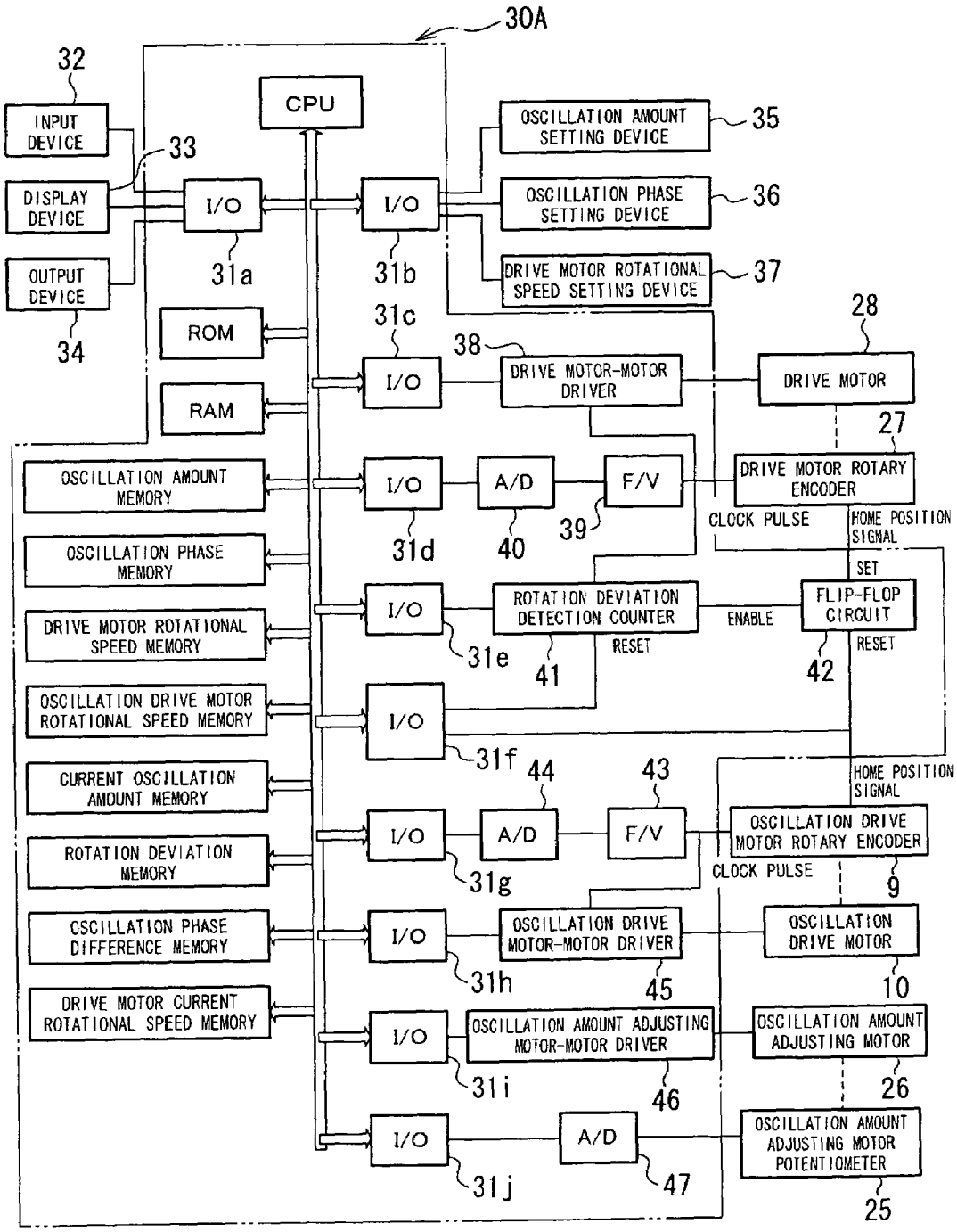
FIG. 3 is a control block diagram.
Figure 4:
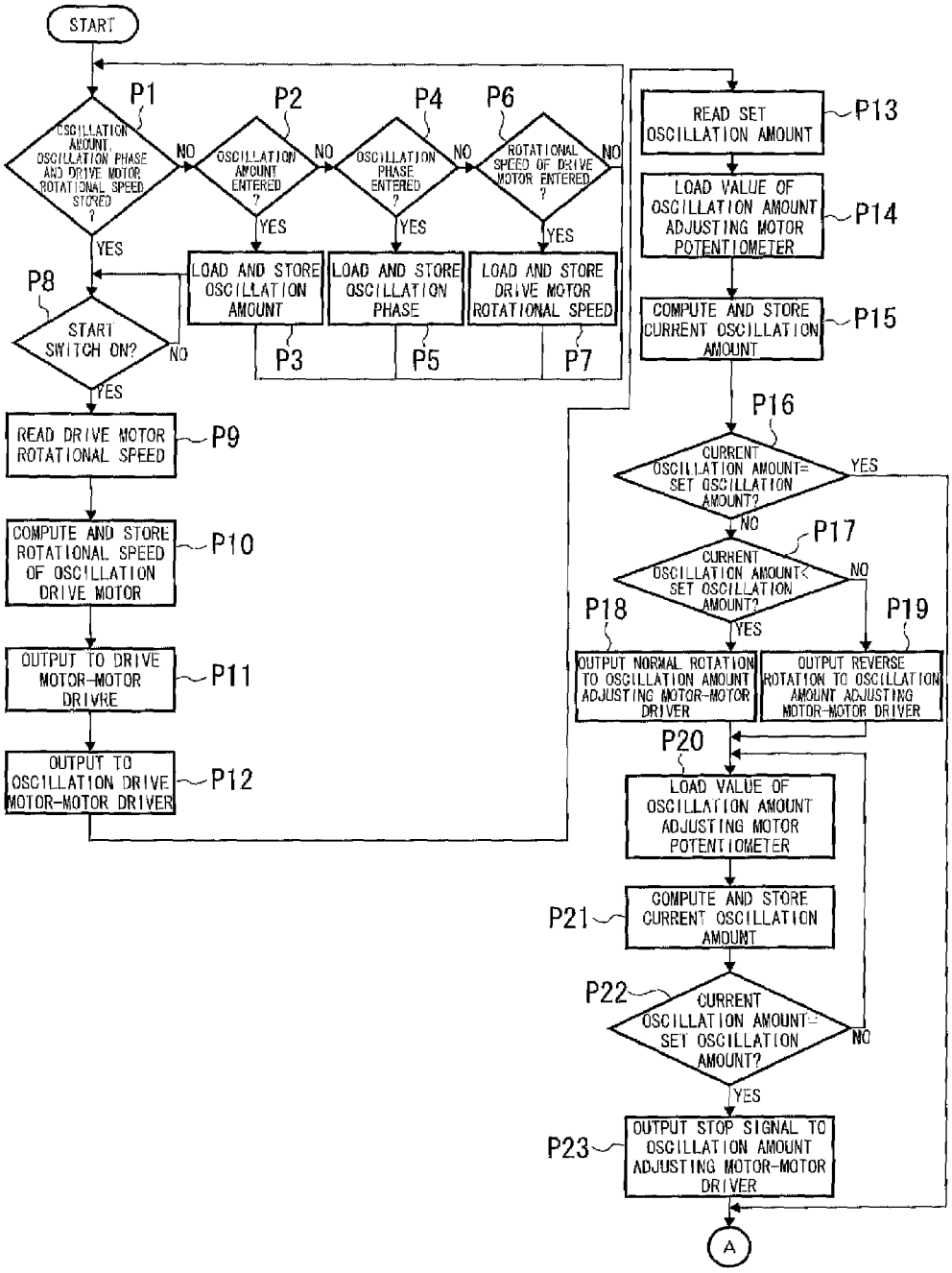
FIG. 4 is a flow chart for oscillation amount/oscillation phase control.
Figure 5:
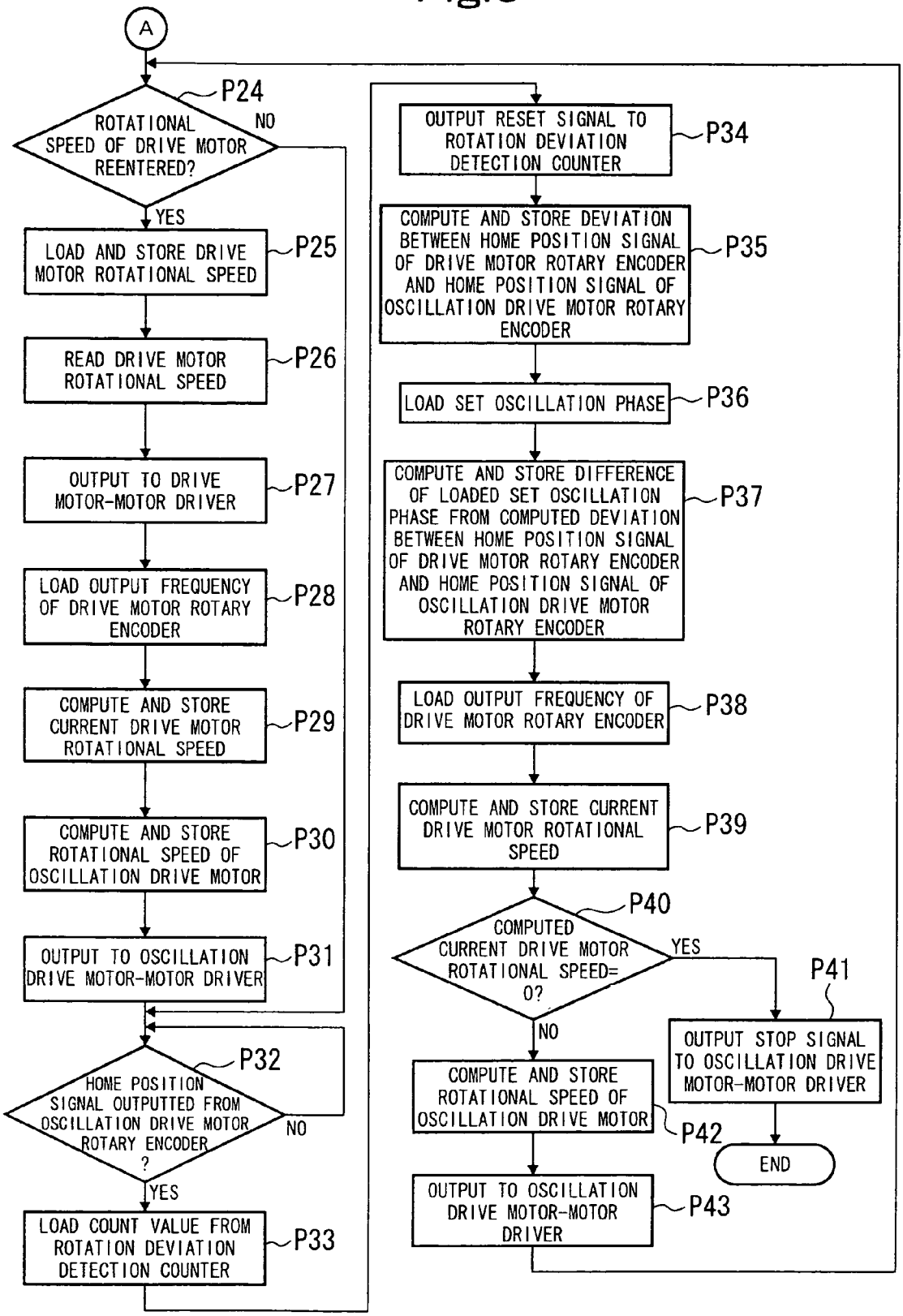
FIG. 5 is a flow chart for the oscillation amount/oscillation phase control.

FIG. 2 is a side view of essential parts thereof. FIG. 3 is a control block diagram. FIG. 4 is a flow chart for oscillation amount/oscillation phase control. FIG. 5 is a flow chart for the oscillation amount/oscillation phase control.

As shown in FIGS. 1 and 2, four oscillating rollers 2*a*, 2*b*, 2*c*, and 2*d* are journaled by a frame 1 of an inking device. A rotating shaft 6, which is journaled by a bearing 3 provided in the frame 1 and a bearing 5 of a first support plate 4 screwed to the frame 1, is provided in a middle portion nearly equally spaced from these oscillating rollers 2*a*, 2*b*, 2*c*, and 2*d*.

The rotating shaft 6 is composed of an inclined shaft portion 7 and a parallel shaft portion 8 located adjacently, the inclined shaft portion 7 being inclined with respect to the axes of the oscillating rollers 2*a*, 2*b*, 2*c*, and 2*d*, and the parallel shaft portion 8 having an axis parallel to the axes of the oscillating rollers 2*a*, 2*b*, 2*c*, and 2*d*. The parallel shaft portion 8 is journaled by the first support plate 4, and is also directly coupled to an oscillation drive motor (first drive means, a dedicated motor) 10 incorporating a rotary encoder 9 (see FIG. 3) which comprises a disk-shaped servo motor or the like. The oscillation drive motor 10 is laterally attached to a second support plate 11 screwed to the first support plate 4.

A cylindrical sleeve 12, which has an outer peripheral surface inclined with respect to the axis of the inclined shaft portion 7 of the rotating shaft 6, is fitted on the inclined shaft portion 7 to be rotatable and unmovable in the axial direction. A disk (oscillating roller engagement member) 14 is supported on the outer peripheral surface of the sleeve 12 via a bearing 13 to be rotatable and unmovable in the axial direction. A spherical body 16 provided at the shaft end of each of the oscillating rollers 2*a*, 2*b*, 2*c*, and 2*d* is fitted in a spherical bearing (engagement portion) 15 provided in an outer peripheral portion of the disk 14.

A fitting groove (engagement portion) 17 is formed in a part of the outer periphery of the sleeve 12. A rotating member 19, which has a fitting protrusion (an engaged portion such as a square pin, a round pin or a cam follower) 18 to be fitted into the fitting groove 17, is rotatably supported on the parallel shaft portion 8 of the rotating shaft 6 via a bearing 20.

An annular gear 21 is fitted around the outer periphery of the rotating member 19, and the annular gear 21 is in mesh with an output gear 22*a* of a harmonic drive (registered trade mark) device 22 as a differential mechanism assembled to the first support plate 4. An inlet gear 22*b* of the harmonic drive device 22 is in mesh with a disk-shaped gear 23 secured to the parallel shaft portion 8 of the rotating shaft 6. Rotations of an oscillation amount adjusting motor (second drive means, a dedicated motor) 26, which is vertically mounted on the second support plate 11 via a worm wheel 24*a* and a worm 24*b* and incorporates a potentiometer 25 (see FIG. 3), are transmitted to a wave generator 22*c* of the harmonic drive device 22.

The harmonic drive device 22 is a publicly known differential mechanism constituted as follows: It is basically composed of the wave generator 22*c*, a flexspline (not shown) fitted about the outer periphery of the wave generator 22*c*, and a pair of circular splines 22*d* meshing with the outer periphery of the flexspline. The number of teeth of the circular spline 22*d* is larger than the number of teeth of the flexspline by two teeth, and the output gear 22*a* is screwed to one of the circular splines 22*d*, while the input gear 22*b* is screwed to the other circular spline 22*d*. In this manner, the speed reduction ratio of the harmonic drive device 22 is determined by the numbers of teeth of the flexspline and the circular splines 22*d*.

During a routine operation, therefore, the oscillation amount adjusting motor 26 is stopped, whereby rotations of the oscillation drive motor 10 are transmitted at a 1:1 ratio in the following order: disk-shaped gear 23→harmonic drive device 22→annular gear 21 and rotating member 19. As a result, the sleeve 12 rotating integrally with the rotating member 19 rotates at the same rotational speed as that of the rotating shaft 6. Upon rotation of the oscillation amount adjusting motor 26, on the other hand, the speed reducing action of the harmonic drive device 22 produces a slight difference in rotation between the disk-shaped gear 23 and the annular gear 21/the rotating member 19 which are rotated by the oscillation drive motor 10. As a result, the phase adjustment of the rotating shaft 6 (inclined shaft portion 7) and the sleeve 12 relative to each other is made, and the oscillation amount of the oscillating rollers 2*a*, 2*b*, 2*c*, and 2*d* is adjusted. After adjustment, the oscillation amount adjusting motor 26 is stopped, whereby the sleeve 12 is returned to the original rotational speed (the same rotational speed as that of the rotating shaft 6).

As shown in FIG. 3, the oscillation drive motor 10 and the oscillation amount adjusting motor 26 are driven and controlled by a control device 30A, as is a drive motor 28 for driving the entire printing press, the drive motor 28 incorporating a rotary encoder 27.

The control device 30A comprises CPU, ROM, and RAM, and also includes an oscillation amount memory, an oscillation phase memory, a drive motor rotational speed memory, an oscillation drive motor rotational speed memory, a current oscillation amount memory, a rotation deviation memory, an oscillation phase difference memory, and a drive motor current rotational speed memory, the CPU, these memories and input/output devices 31*a* to 31*j* being connected together by a bus-line BUS.

An input device 32, such as a start switch or a key board, a display device 33 such as a CRT or a display, and an output device 34, such as a printer or a floppy (registered trade mark) disk drive, are connected to the input/output device 31*a*. An oscillation amount setting device 35 for setting the oscillation amount of the oscillating rollers 2*a*, 2*b*, 2*c*, and 2*d*, an oscillation phase setting device 36 for setting the oscillation phases of the oscillating rollers 2*a*, 2*b*, 2*c*, and 2*d*, and a drive motor rotational speed setting device 37 for setting the rotational speed of the drive motor 28 are connected to the input/output device 31*b*.

The drive motor 28 is connected to the input/output device 31*c* via a drive motor-motor driver 38. The drive motor rotary encoder 27 is connected to the input/output device 31*d* via an F/V converter 39 and an A/D converter 40. A rotation deviation detection counter 41 is connected to the input/output device 31*e*, and the rotation deviation detection counter 41 is connected to the drive motor rotary encoder 27 and the oscillation drive motor rotary encoder 9 via a flip-flop circuit 42. Detection signals (clock pulses) from the drive motor rotary encoder 27 are entered into the drive motor-motor driver 38 and the rotation deviation detection counter 41.

The rotation deviation detection counter 41 and the oscillation drive motor rotary encoder 9 are connected to the input/output device 31*f*. The oscillation drive motor rotary encoder 9 is connected to the input/output device 31*g* via an F/V converter 43 and an A/D converter 44. The oscillation drive motor 10 is connected to the input/output device 31*h* via an oscillation drive motor-motor driver 45. Detection signals (clock pulses) from the oscillation drive motor rotary encoder 9 are entered into the oscillation drive motor-motor driver 45.

The oscillation-amount adjusting motor 26 is connected to the input/output device 31*i* via an oscillation amount adjusting motor-motor driver 46. The oscillation amount adjusting motor potentiometer (drive amount detector) 25 is connected to the input/output device 31*j* via an A/D converter 47.

Because of the above-described features, during a routine operation, the oscillation drive motor 10 is rotated, with the oscillation amount adjusting motor 26 at a standstill. By this action, the sleeve 12 rotates at the same rotational speed as that of the rotating shaft 6 (inclined shaft portion 7) as stated earlier, and the oscillatory motion of the inclined shaft portion 7 results in the grinding motion of the disk 14. As a result, the oscillating rollers 2*a*, 2*b*, 2*c*, and 2*d* are sequentially swung in the axial direction in a different phase and in a predetermined oscillation amount.

On this occasion, the home position of the oscillation drive motor 10 and the home position of the drive motor 28 are brought into registry, and then the home position of the oscillation drive motor 10 is displaced from the home position of the drive motor 28 by a predetermined amount, whereby the oscillation phase of the oscillating rollers 2*a*, 2*b*, 2*c*, and 2*d* is adjusted to a predetermined oscillation phase.

When the oscillation amount adjusting motor 26 is rotated in the above-mentioned state, a slight difference in rotation is produced between the disk-shaped gear 23 and the annular gear 21/rotating member 19, which are rotated by the oscillation drive motor 10, under the action of the harmonic drive device 22. As a result, the phase adjustment of the rotating shaft 6 (inclined shaft portion 7) and the sleeve 12 relative to each other is made, whereby the oscillation amount of the oscillating rollers 2*a*, 2*b*, 2*c*, and 2*d* is varied by the amount of rotation of the oscillation amount adjusting motor 26. Consequently, the oscillation amount of the oscillating rollers 2*a*, 2*b*, 2*c*, and 2*d* is adjusted to a predetermined oscillation amount.

The oscillation amount/oscillation phase control of the oscillating rollers 2*a*, 2*b*, 2*c*, and 2*d* explained above will be described in more detail according to flow charts of FIGS. 4 and 5.

In Step P1, it is determined whether the oscillation amount is stored in the oscillation amount memory, whether the oscillation phase is stored in the oscillation phase memory, and whether the drive motor rotational speed is stored in the drive motor rotational speed memory. If these parameters are not stored, the oscillation amount is entered into the oscillation amount setting device 35 in Step P2, whereby the oscillation amount entered into the oscillation amount setting device 35 is loaded and stored in the oscillation amount memory in Step P3. Similarly, Step P4 and Step P5 are executed to store the oscillation phase in the oscillation phase memory. Also, Step P6 and Step P7 are executed to store the drive motor rotational speed in the drive motor rotational speed memory.

If the relevant parameters are stored in Step P1, the start switch is turned on in Step P8 to start the oscillation amount control of the oscillating rollers 2*a*, 2*b*, 2*c*, and 2*d*.

Then, in Step P9, the drive motor rotational speed is loaded from the drive motor rotational speed memory. Then, in Step P10, the rotational speed of the oscillation drive motor 10 is computed from the loaded drive motor rotational speed, and the rotational speed of the oscillation drive motor 10 obtained by computation is stored in the rotational speed memory of the oscillation drive motor. Then, in Step P11, the loaded drive motor rotational speed is outputted to the drive motor-motor driver 38. In Step P12, the rotational speed of the oscillation drive motor 10 obtained by computation is outputted to the oscillation drive motor-motor driver 45.

Then, in Step P13, the set oscillation amount is loaded from the oscillation amount memory. Then, in Step P14, the value of the oscillation amount adjusting motor potentiometer 25 is read. Then, in Step P15, the current oscillation amount is computed from the value of the oscillation amount adjusting motor potentiometer 25 read above, and the current oscillation amount obtained by computation is stored in the current oscillation amount memory.

Then, in Step P16, it is determined whether the current oscillation amount is consistent with the set oscillation amount. If it is not consistent, it is determined in Step P17 whether the current oscillation amount is smaller than the set oscillation amount. If it is smaller, a normal rotation signal is outputted to the oscillation amount adjusting motor-motor driver 46 in Step P18. If it is larger, on the other hand, a reverse rotation signal is outputted to the oscillation amount adjusting motor-motor driver 46 in Step P19.

Then, in Step P20, the value of the oscillation amount adjusting motor potentiometer 25 is loaded. Then, in Step P21, the current oscillation amount is computed from the loaded value of the oscillation amount adjusting motor potentiometer 25, and the current oscillation amount obtained by computation is stored in the current oscillation amount memory. Then, in Step P22, a determination is made as to whether the current oscillation amount is consistent with the set oscillation amount. If YES, a stop signal is outputted to the oscillation amount adjusting motor-motor driver 46 in Step P23 to stop oscillation amount control. Then, the program proceeds to Step P24.

If consistency is found in Step P16, oscillation amount control is immediately stopped, and the program shifts to Step P24 to carry out oscillation phase control. That is, in step P24, it is determined whether the rotational speed of the drive motor 28 has been reentered into the drive motor rotational speed setting device 37. If it has been reentered, the drive motor rotational speed entered into the drive motor rotational speed setting device 37 is loaded and stored in the drive motor rotational speed memory in Step P25. Then, in Step P26, the drive motor rotational speed is read from the drive motor rotational speed memory. Then, in Step P27, the drive motor rotational speed read above is outputted to the drive motor-motor driver 38.

Then, in Step P28, the output frequency (clock pulses) of the drive motor rotary encoder 27 is loaded in Step P28. Then, in Step P29, the current rotational speed of the drive motor 28 is computed from the output frequency of the drive motor rotary encoder 27 loaded above, and the current rotational speed of the drive motor 28 obtained by computation is stored in the current rotational speed memory of the drive motor.

Then, in Step P30, the rotational speed of the oscillation drive motor 10 is computed from the current rotational speed of the drive motor 28 obtained by computation, and the rotational speed of the oscillation drive motor 10 obtained by computation is stored in the oscillation drive motor rotational speed memory. Then, in Step P31, the rotational speed of the oscillation drive motor 10 obtained by computation is outputted to the oscillation drive motor-motor driver 45. Then, the program proceeds to Step P32.

If there is no reentry in Step P24, the program immediately shifts to the above-mentioned Step P32. In Step P32, it is determined whether a home position signal has been outputted from the oscillation drive motor rotary encoder 9. If YES, the count value is loaded from the rotation deviation detection counter 41 in Step P33. Then, in Step P34, a reset signal is outputted to the rotation deviation detection counter 41.

Then, in Step P35, a deviation between the home position signal of the drive motor rotary encoder 27 and the home position signal of the oscillation drive motor rotary encoder 9 is computed from the count value loaded above, and stored in the rotation deviation memory. Then, in Step P36, the set oscillation phase is read from the oscillation phase memory.

Then, in Step P37, the difference between the above deviation obtained by computation, i.e., the deviation between the home position signal of the drive motor rotary encoder 27 and the home position signal of the oscillation drive motor rotary encoder 9, and the set oscillation phase read above is computed, and stored in the oscillation phase difference memory. Then, in Step P38, the output frequency of the drive motor rotary encoder 27 is loaded.

Then, in Step P39, the current rotational speed of the drive motor 28 is computed from the output frequency of the drive motor rotary encoder 27 loaded above, and stored in the drive motor current rotational speed memory. Then, in Step P40, it is determined whether the current rotational speed of the drive motor 28 obtained by computation is 0 (zero). If it is 0, a stop signal is outputted to the oscillation drive motor-motor driver 45 in Step P41 to terminate oscillation phase control.

If the rotational speed is not 0 in Step P40, the rotational speed of the oscillation drive motor 10 is computed in Step P42 from the difference between the deviation obtained by computation—the deviation between the home position signal of the drive motor rotary encoder 27 and the home position signal of the oscillation drive motor rotary encoder 9—and the set oscillation phase and from the current rotational speed of the drive motor 28 obtained by computation, and is stored in the oscillation drive motor rotational speed memory. Then, in Step P43, the rotational speed of the oscillation drive motor 10 obtained by computation is outputted to the oscillation drive motor-motor driver 46, and the program returns to Step P24 to continue oscillation phase control.

In the present embodiment, as described above, the rotating member 19, which is engaged with the sleeve 12 and supported rotatably on the parallel shaft portion 8 of the rotating shaft 6, is rotated by the oscillation amount adjusting motor 26, whereby the oscillation amount of the oscillating rollers 2*a*, 2*b*, 2*c*, 2*d* can be adjusted. Thus, oscillation amount adjustment can be made with high accuracy by remote and automatic control using a motor, whereby marked reduction of the working time is achieved.

During a routine operation, moreover, the disk 14 makes a grinding motion upon the oscillatory motion of the inclined shaft portion 7. Thus, the oscillating rollers 2*a*, 2*b*, 2*c*, 2*d* swing in the axial direction. At this time, the oscillating rollers 2*a*, 2*b*, 2*c*, 2*d* swing sequentially in shifted phases in accordance with the order of their arrangement. As a result, their ink distribution is performed in different phases, and their swing takes place individually, so that high quality printing free from shock can be achieved. In addition, the oscillation mechanism is compact, thus ensuring space saving.

Furthermore, the rotating shaft 6 is rotated by the oscillation drive motor 10, which is a dedicated motor. Thus, the home position of the oscillation drive motor 10 and the home position of the drive motor 28 are brought into registry, whereafter the home position of the oscillation drive motor 10 is displaced from the home position of the drive motor 28 by a predetermined amount. By this measure, the oscillation phase of the oscillating rollers 2*a*, 2*b*, 2*c*, and 2*d* can be adjusted arbitrarily to a predetermined oscillation phase.

Besides, the harmonic drive device 22 is interposed in the drive route of the oscillation amount adjusting motor 26. Thus, it is sufficient for the oscillation amount adjusting motor 26, which is a dedicated motor, to be rotated temporarily at the time of oscillation amount adjustment. Hence, a saving in electrical power is achieved. Also, the parallel shaft portion 8, which supports the rotating member 19, is formed integrally with the rotating shaft 6. Thus, simplification and improved assembly workability of the oscillating roller swing device are achieved.

In the foregoing embodiment, the rotating shaft 6 may be rotated and driven by the drive motor 28 via a gear mechanism, without the use of the dedicated oscillation drive motor 10. Moreover, the rotating shaft 6 and the parallel shaft portion 8 may be formed as separate members.

Second Embodiment

Figure 6:
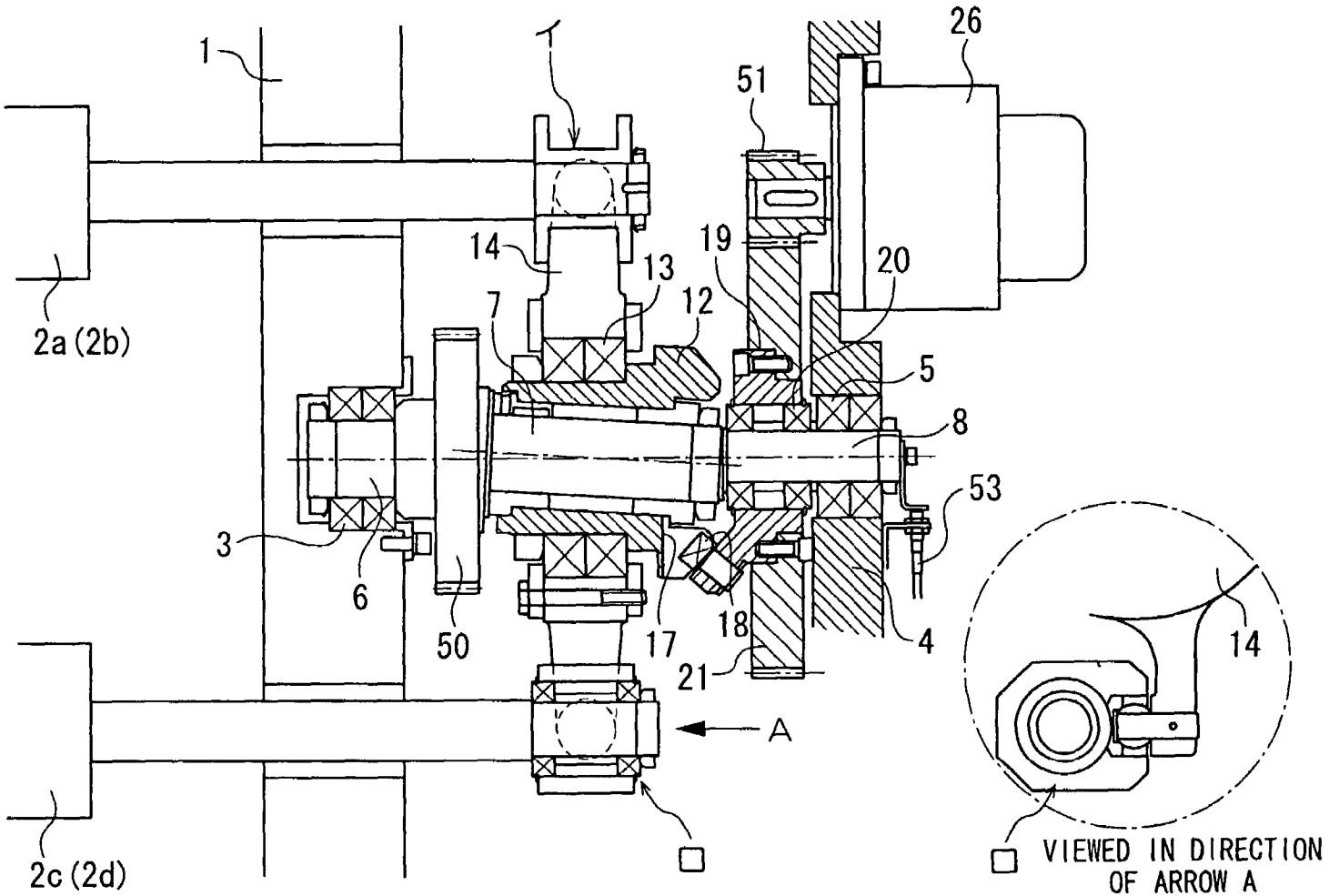
FIG. 6 is a front sectional view of an oscillating roller swing device of an inking device in a printing press, showing a second embodiment of the present invention.
Figure 8:
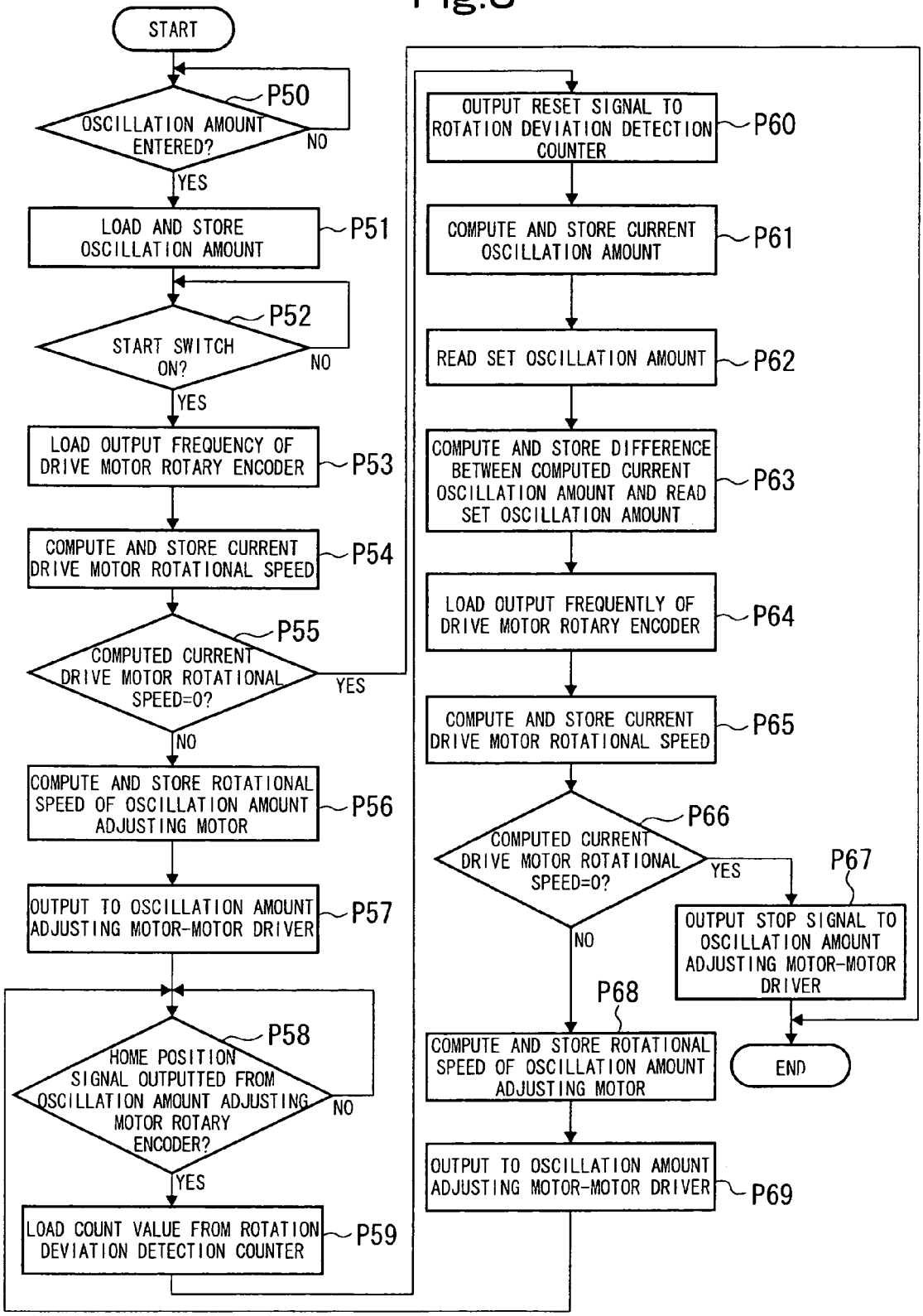
FIG. 8 is a flow chart for oscillation amount control.
Figure 9:
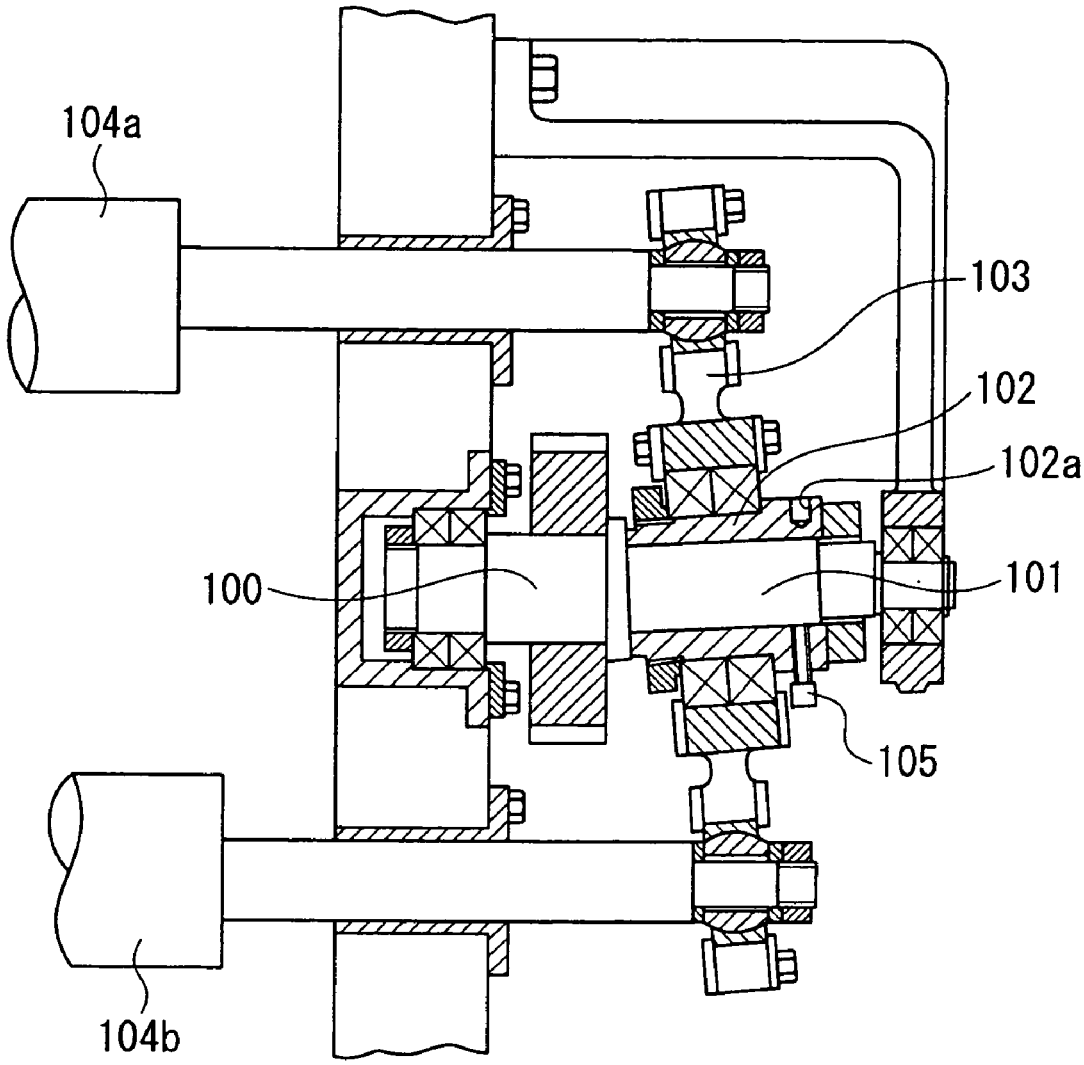
FIG. 9 is a front sectional view of an oscillating roller swing device of an inking device, showing a conventional example.

FIG. 6 is a front sectional view of an oscillating roller swing device of an inking device in a printing press, showing a second embodiment of the present invention. FIG. 7 is a control block diagram. FIG. 8 is a flow chart for oscillation amount control.

This embodiment is constituted overall such that the rotating shaft 6 in the First Embodiment, which supports the sleeve 12 at the inclined shaft portion 7 to be rotatable, is rotated and driven via a gear 50 by the drive motor for driving the entire printing press, and that the rotating member 19, which is engaged with the sleeve 12 and rotatably supported on the parallel shaft portion 8 of the rotating shaft 6, is rotationally driven via gears 21 and 51 by an oscillation amount adjusting motor 26 incorporating a rotary encoder 52 (see FIG. 7).

In the first support plate 4, an oscillating roller home position detector 53, such as an optical sensor, for detecting the home position signal of the drive motor (oscillating rollers 2*a*, 2*b*, 2*c*, 2*d*) is annexed to the parallel shaft portion 8 of the rotating shaft 6. In the present embodiment, moreover, shaft support portions (engaging portions, engaged portions; indicated by the katakana letters イ and ロ) for supporting the shaft ends of the oscillating rollers 2*a*, 2*b*, 2*c*, 2*d* are illustrated. The shaft support portion イ adopts a cam follower and a sheave, while the shaft support portion ロ adopts a bearing and a spherical plain bearing.

As shown in FIG. 7, a control device 30B controls the oscillation amount adjusting motor 26 in response to signals from an oscillation amount setting device 35 for setting the oscillation amount (swing amount) of the oscillating rollers 2*a*, 2*b*, 2*c*, 2*d*, and signals from the oscillation amount adjusting motor rotary encoder 52 for detecting the drive amount of the oscillation amount adjusting motor 26, thereby adjusting the oscillation amount of the oscillating rollers 2*a*, 2*b*, 2*c*, 2*d*.

That is, the oscillating roller home position detector 53 is connected to an input/output device 31*m*, and the oscillation amount adjusting motor rotary encoder 52 is connected to an input/output device 31*n* via an F/V converter 54 and an A/D converter 55. The oscillating roller home position detector 53 and the oscillation amount adjusting motor rotary encoder 52 are connected to a rotation deviation detection counter 41 via a flip-flop circuit 42. Other features are the same as those in the First Embodiment, and duplicate explanations are omitted.

To adjust the oscillation amount of the oscillating rollers 2*a*, 2*b*, 2*c*, 2*d*, adjustment starts in a state where the drive motor and the oscillation amount adjusting motor 26 rotate at the same rotational speed. From this state, the rotational speed of the oscillation amount adjusting motor 26 is increased or decreased with respect to the rotational speed of the drive motor. By this measure, the rotation phase of the sleeve 12 relative to the rotating shaft 6 changes, enabling the oscillation amount of the oscillating rollers 2*a*, 2*b*, 2*c*, 2*d* to be adjusted. After adjustment, the rotational speed of the oscillation amount adjusting motor 26 is returned to the original level.

Such oscillation amount control of the oscillating rollers 2*a*, 2*b*, 2*c*, 2*d* will be described in detail with reference to a flow chart of FIG. 8.

When the oscillation amount is entered into the oscillation amount setting device 35 in Step P50, the oscillation amount entered above is loaded and stored in the oscillation amount memory in Step P51. Then, the start switch is turned on in Step P52 to start oscillation amount control of the oscillating rollers 2*a*, 2*b*, 2*c*, 2*d*.

Then, the output frequency (clock pulses) of the drive motor rotary encoder 27 is loaded in Step P53. Then, in Step P54, the current rotational speed of the drive motor 28 is computed from the output frequency of the drive motor rotary encoder 27 loaded above, and the current rotational speed of the drive motor 28 obtained by computation is stored in the current drive motor rotational speed memory.

Then, in Step P55, it is determined whether the current rotational speed of the drive motor 28 obtained by computation is 0 (zero) or not. If it is 0 (zero), oscillation amount control is discontinued. If it is not 0 (zero), the rotational speed of the oscillation amount adjusting motor 26 is computed in Step P56 from the current rotational speed of the drive motor 28 obtained by computation. In this step, the rotational speed of the oscillation amount adjusting motor 26 obtained by computation is stored in the oscillation amount adjusting motor rotational speed memory. Then, in Step P57, the rotational speed of the oscillation amount adjusting motor 26 obtained by computation is outputted to the oscillation amount adjusting motor-motor driver 46.

Then, in Step P58, it is determined whether a home position signal has been outputted from the rotary encoder 52 for the oscillation amount adjusting motor. If it has been outputted, the count value is loaded from the rotation deviation detection counter 41 in Step P59. Then, in Step P60, a reset signal is outputted to the rotation deviation detection counter 41.

Then, in Step P61, the current oscillation amount is computed from the count value loaded above, and the current oscillation amount obtained by computation is stored in the current oscillation amount memory.

Then, the set oscillation amount is read from the oscillation amount memory in Step P62. Then, the difference between the current oscillation amount obtained by computation and the set oscillation amount read above is computed in Step P63, and this difference between the current oscillation amount obtained by computation and the set oscillation amount read is stored in the oscillation amount difference memory in this step. Then, the output frequency of the drive motor rotary encoder 27 is loaded in Step P64.

Then, in Step P65, the current rotational speed of the drive motor 28 is computed from the output frequency of the drive motor rotary encoder 27 loaded above, and is stored in the drive motor current rotational speed memory. Then, in Step P66, it is determined whether the current rotational speed of the drive motor 28 obtained by computation is 0 (zero) or not. If it is 0, a stop signal is outputted to the oscillation amount adjusting motor-motor driver 46 in Step P67 to terminate oscillation amount control.

If the parameter is not 0 in Step P66, the rotational speed of the oscillation amount adjusting motor 26 is computed in Step P68 from the difference between the current oscillation amount obtained by computation and the set oscillation amount, and from the current rotational speed of the drive motor 28 obtained by computation, and the rotational speed of the oscillation amount adjusting motor 26 obtained by computation is stored in the oscillation amount adjusting motor rotational speed memory in this step. Then, in Step P69, the rotational speed of the oscillation amount adjusting motor 26 obtained by computation is outputted to the oscillation amount adjusting motor-motor driver 46. Then, the program returns to Step P58 to continue oscillation amount control.

In the present embodiment, as described above, the rotating member 19, which engages the sleeve 12 and is rotatably supported on the parallel shaft portion 8 of the rotating shaft 6, is rotated by the oscillation amount adjusting motor 26, whereby the oscillation amount of the oscillating rollers 2*a*, 2*b*, 2*c*, 2*d* can be adjusted, as in the case of the First Embodiment. Thus, oscillation amount adjustment can be made with high accuracy by remote and automatic control using a motor, whereby marked reduction of the working time is achieved.

During a routine operation, moreover, the disk 14 makes a grinding motion upon the oscillatory motion of the inclined shaft portion 7. Thus, the oscillating rollers 2*a*, 2*b*, 2*c*, 2*d* swing in the axial direction. At this time, the oscillating rollers 2*a*, 2*b*, 2*c*, 2*d* swing sequentially in shifted phases in accordance with the order of their arrangement. As a result, their ink distribution is performed in different phases, and their swing takes place individually, so that high quality printing free from shock can be achieved. In addition, the oscillation mechanism is compact, thus ensuring space saving, as in the First Embodiment. In the present embodiment, in particular, the rotating shaft 6 is rotated and driven by the drive motor. Thus, as compared with the case where the rotating shaft 6 is rotated and driven by a dedicated motor, the number of the components can be decreased to cut down on the costs.

In the present embodiment, moreover, the control device 30B controls the oscillation amount adjusting motor 26 in response to signals from the oscillation amount setting device 35, and signals from the oscillation amount adjusting motor rotary encoder 52, thereby adjusting the oscillation amount of the oscillating rollers 2*a*, 2*b*, 2*c*, 2*d*. This affords the advantage that simple control suffices.

In the above embodiments, the relationship between the oscillation amount adjusting motor 26 and the drive motor may be reversed.

While the present invention has been described by the above embodiments, it is to be understood that the invention is not limited thereby, but may be varied or modified in many other ways. For example, a drive means capable of driving two shafts by means of, say, a planet gear to perform phase adjustment may be used instead of the harmonic drive device 22 in the First Embodiment. Moreover, a motor with a speed reducer may be used as the oscillation drive motor 10 in the First Embodiment, and meshed with the gear. Also, the sleeve 12 may be adapted to be friction driven by the rotating member 19. Such variations or modifications are not to be regarded as a departure from the spirit and scope of the invention, and all such variations and modifications as would be obvious to one skilled in the art are intended to be included within the scope of the appended claims.

What is claimed is:

1. An oscillation amount adjusting device for an oscillating roller in an oscillating roller swing device, said oscillating roller swing device including, an oscillating roller swung in an axial direction, a rotating shaft rotatably supported by a frame and having an inclined shaft portion inclined with respect to an axis of said oscillating roller, a cylindrical sleeve rotatably supported on said inclined shaft portion of said rotating shaft and having an outer peripheral surface inclined with respect to an axis of said inclined shaft portion, an oscillating roller engagement member rotatably supported on said sleeve and having an engagement portion engaging said oscillating roller, and first drive means for rotating said rotating shaft, said oscillation amount adjusting device, comprising:

an engaging portion provided in said sleeve;

a parallel shaft portion having an axis parallel to said axis of said oscillating roller;

a rotating member rotatably supported on said parallel shaft portion and provided with an engaged portion engaging said engaging portion of said sleeve; and second drive means for rotating said rotating member relative to said rotating shaft.

2. The oscillation amount adjusting device for an oscillating roller according to claim 1, wherein said parallel shaft portion is provided in said rotating shaft.

3. The oscillation amount adjusting device for an oscillating roller according to claim 1, further comprising:

a differential mechanism provided on a drive route between said rotating member and said first drive means, and said differential mechanism adjusting a rotation phase between said rotating member and said first drive means by said second drive means.

4. The oscillation amount adjusting device for an oscillating roller according to claim 3, wherein said differential mechanism is a harmonic drive device, an output side of said harmonic drive device is connected to said rotating member via a gear mechanism and an input side of said harmonic drive device is connected to said rotating shaft via a gear mechanism, and a wave generator of said harmonic drive device is connected to said second drive means via a gear mechanism.

5. The oscillation amount adjusting device for an oscillating roller according to claim 1, wherein said first drive means and said second drive means are motors.

6. The oscillation amount adjusting device for an oscillating roller according to claim 1, wherein of said first drive means and said second drive means, one drive means is a dedicated motor, and other drive means is a drive motor for driving an entire machine.

7. The oscillation amount adjusting device for an oscillating roller according to claim 6, wherein said first drive means is said drive motor for driving said entire machine and is connected to said rotating shaft via a gear mechanism, while said second drive means is said dedicated motor and is connected to said rotating member via a gear mechanism.

8. The oscillation amount adjusting device for an oscillating roller according to claim 1, further comprising:

an oscillation amount setting device for setting a swing amount of said oscillating roller;

a drive amount detector for detecting a drive amount of said second drive means; and a control device for controlling said second drive means in response to a signal from said oscillation amount setting device and a signal from said drive amount detector.

* * * * *